US006311617B1

(12) United States Patent
Herden et al.

(10) Patent No.: US 6,311,617 B1
(45) Date of Patent: Nov. 6, 2001

(54) PRINTING PRESS WITH A VIBRATOR-LIKE INKING UNIT AND METHOD OF OPERATING THE PRINTING PRESS

(75) Inventors: Matthias Herden, Ludwigshafen; Bernhard Wagensommer, Gaiberg, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/420,460

(22) Filed: Oct. 18, 1999

(30) Foreign Application Priority Data

Oct. 16, 1998 (DE) ..... 198 47 829

(51) Int. Cl.[7] ..... B41F 31/06; B41F 31/14

(52) U.S. Cl. ..... 101/350.3; 101/351.3; 101/DIG. 32

(58) Field of Search ..... 101/350.1, 350.3, 101/351.3, 352.04, 352.06, 352.09, 148, DIG. 32, DIG. 38

(56) References Cited

U.S. PATENT DOCUMENTS 5,566,613 10/1996 Stoffler et al. .
5,685,225 * 11/1997 Gensheimer et al. ..... 101/350
5,826,508 * 10/1998 Komori ..... 101/350.3

FOREIGN PATENT DOCUMENTS 44 36 102 A1 4/1996 (DE) .
298 09 948 U1 9/1998 (DE) .

* cited by examiner

*Primary Examiner*—Ren Yan
(74) *Attorney, Agent, or Firm*—Herbert L. Lerner; Laurence A. Greenberg; Werner H. Stemer

(57) ABSTRACT

A printing press has a ductor inking unit that includes a ductor roller and a motor for moving the ductor roller via a rotatable cam disc, the motor being constructed so as to subject the cam disc to periodic angular acceleration at constant printing speed of the printing press, and so as to rotate the cam disc alternatingly in opposite rotational directions; and a method of operating the printing press.

7 Claims, 4 Drawing Sheets

PRINTING PRESS WITH A VIBRATOR-LIKE INKING UNIT AND METHOD OF OPERATING THE PRINTING PRESS

BACKGROUND OF THE INVENTION

FIELD OF THE INVENTION

The invention concerns a printing press with a vibrator-like or ductor-like inking unit that includes a vibrator or ductor roller that is movable by a motor via a rotatable cam disc, and a method for operating such a printing press.

The published German Patent Document DE 44 36 102 A1 describes a device and a method for controlled transfer of printing ink. The device includes an ink vibrator or ductor roller reciprocatingly movable by a swivel mechanism having an intermittent drive. In one embodiment of the device, a rotatable motor is provided that is connected to a cam-disc segment having two different radii, however, no information is presented about the type of construction of the motor.

In the published German Patent Document DE 44 28 403 C2, a ductor or vibrator drive is described having a cam disc to which a speed-controllable, irregularly drivable drive is assigned. Also provided is a roller of a supporting lever of the ductor or vibrator roller, the supporting-lever roller running along the cam disc. The cam disc occasionally runs at a speed correlating with the printing speed of the printing press and, when the supporting-lever roller runs along the section of the cam disc that causes the ductor roller to be thrown on and thrown off, the cam disc runs at a constant speed independently of the printing speed.

The last-mentioned patent document does not address either the problems associated with the roller lifting from the cam disc due to centrifugal force, or a reduction in the speed of the cam disc.

In the published European Patent Document EP 0 623 468 B1, a ductor or vibrator inking unit for a printing press is described which includes two cam discs having a large radius of curvature for most of the peripheral contour thereof, and a small radius of curvature in the remaining part of the peripheral contour thereof.

Both the device for the controlled transfer of printing ink and also the ductor inking unit, respectively, represent a favorable structural concept for the basic task of the inking unit and the device, respectively. For other cases, however, these systems are unfavorable. In particular, a cam roller following the described cams can lift from the cam at high machine speeds, the position of the ductor roller being occasionally undefined.

SUMMARY OF THE INVENTION

It is accordingly an object of the invention to provide a printing press with a ductor or vibrator inking unit that operates reliably at high machine speeds. A further object of the invention is to provide a method for operating such a printing press.

With the foregoing and other objects in view, there is provided, in accordance with one aspect of the invention, a printing press with a ductor inking unit having a ductor roller and comprising a motor for moving the ductor roller via a rotatable cam disc, the motor being constructed so as to subject the cam disc to periodic angular acceleration at constant printing speed of the printing press, and so as to rotate the cam disc alternatingly in opposite rotational directions.

In accordance with another feature of the invention, the cam disc has two peripheral sections contoured as circular arcs and defined by different radii of curvature.

In accordance with a further feature of the invention, the cam disc is peripherally contoured in an approximately spiral shape.

In accordance with another aspect of the invention, there is provided a printing press with a ductor inking unit having a ductor roller and comprising a motor for moving the ductor roller via a rotatable cam disc having two peripheral sections contoured as circular arcs and defined by different radii of curvature and via a cam roller rolling on the cam disc, the motor being constructed so as to drive the cam disc with periodic angular acceleration at constant printing speed of the printing press, the cam disc being rotatable at a reduced speed by the motor when the cam roller traverses a peripheral section of the cam disc having a curvature tending to cause the cam roller to be lifted from the cam disc.

In accordance with an added feature of the invention, the motor is constructed so as to drive the cam disc in a single direction of rotation.

In accordance with an additional feature of the invention, the motor is constructed so as to turn the cam disc alternatingly in opposite directions of rotation.

In accordance with yet another feature of the invention, the motor is an electric motor controllable by an electronic control in dependence upon a printing-press drive for determining the printing speed, and for rotating the motor with periodic angular acceleration.

In accordance with yet a further feature of the invention, the motor has a shaft, and the cam disc is disposed on the shaft in a position coaxial therewith, the cam disc being fixed to the motor shaft against rotation relative thereto.

In accordance with an additional aspect of the invention, there is provided a method for operating a printing press with a ductor inking unit having a ductor roller movable by a motor via a rotatable cam disc, which includes turning the cam disc by the motor alternatingly in opposite directions of rotation and subjecting the cam disc to periodic angular acceleration while the printing speed of the printing press is held constant.

In accordance with a concomitant aspect of the invention, there is provided a method for operating a printing press with a ductor inking unit having a ductor roller movable by a motor via a rotatable cam disc having two peripheral sections contoured as circular arcs defined by two different radii of curvature, which comprises driving the cam disc by the motor with periodic angular acceleration while the printing speed of the printing press is held constant, and controlling the motor by an electronic control so that a spring-loaded roller of a cam drive rolling on the cam disc is held securely in contact with the cam disc at all times, by having the cam disc rotated at a reduced speed by the motor while the cam-drive roller runs over a peripheral section of the cam disc that, due to the curvature thereof, tends to lift the cam-drive roller from the cam disc.

A printing press according to the invention has a ductor inking unit that includes a ductor roller movable by a motor through the intermediary of a rotatable cam disc, the motor being constructed so as to subject the cam disc to periodic angular acceleration at constant printing speed of the printing press and so as to rotate alternatingly in opposite rotary directions.

In a further embodiment beneficial for the printing press, the cam disc has two peripheral sections contoured as circular arcs and defined by different radii of curvature.

In a further embodiment, the cam disc is peripherally contoured to have a spiral or substantially spiral shape.

A further embodiment of the printing press according to the invention has a ductor inking unit that includes a ductor roller movable by a motor via a rotatable cam disc, the cam disc having two peripheral sections contoured as circular arcs and defined by different radii of curvature, and the motor being constructed to drive the cam disc so that it is subjected to periodic angular acceleration at constant printing speed of the printing press, the cam disc being rotated by the motor with reduced speed while the roller rolls on the cam disc over a peripheral section thereof having a curvature tending to lift the roller from the cam disc.

A further embodiment involves an advantageous development of the printing press according to the invention in that the motor is constructed to drive the cam disc rotatingly in a single direction, in particular, intermittently.

A further embodiment calls for the motor to be constructed so as to rotate the cam disc alternatingly in opposite rotary directions.

A further embodiment involving a development of the printing press according to the invention calls for the motor to be an electric motor controllable by an electronic control system in a manner dependent upon a printing press drive determining the printing speed, and rotating subject to periodic angular acceleration.

A further embodiment that is also suitable for the development of printing press described hereinbefore is characterized by the cam disc being disposed coaxially with a shaft of the motor and fixed to the motor shaft against rotation relative thereto.

In a method for operating a printing press according to the invention, wherein the printing press includes a ductor inking unit with a ductor roller movable by a motor via a rotatable cam disc, the cam disc is subjected by the motor to periodic angular acceleration, and is alternatingly rotated in opposite rotary directions while the printing speed of the printing press is held constant.

In a further improved method for operating a printing press according to the invention wherein the printing press includes a ductor inking unit with a ductor roller movable by a motor via a rotatable cam disc, the method is based upon the same principle as that of the method previously described above, the cam disc having two peripheral sections contoured as circular arcs defined by different radii of curvature, the cam disc being driven by the motor with periodic angular acceleration while the printing speed of the printing press is held constant. In this method the motor is controlled by an electronic control system so that a spring-loaded roller of a cam drive moving the ductor roller, the spring-loaded roller rolling along on the cam disc, is held securely in contact with the cam disc at all times, the cam disc being rotated by the motor at diminished speed while the roller rolling on the cam disc runs through a peripheral section of the cam disc having contours tending to lift the roller rolling on the cam disc away from the cam disc.

The printing press can be a rotary printing press processing web or sheet material and operating according to a direct or indirect letterpress or planographic printing method, for example, according to the letterpress or according to the offset printing method.

Other features which are considered as characteristic for the invention are set forth in the appended claims.

Although the invention is illustrated and described herein as embodied in a printing press with a ductor or vibrator inking unit and a method of operating the printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
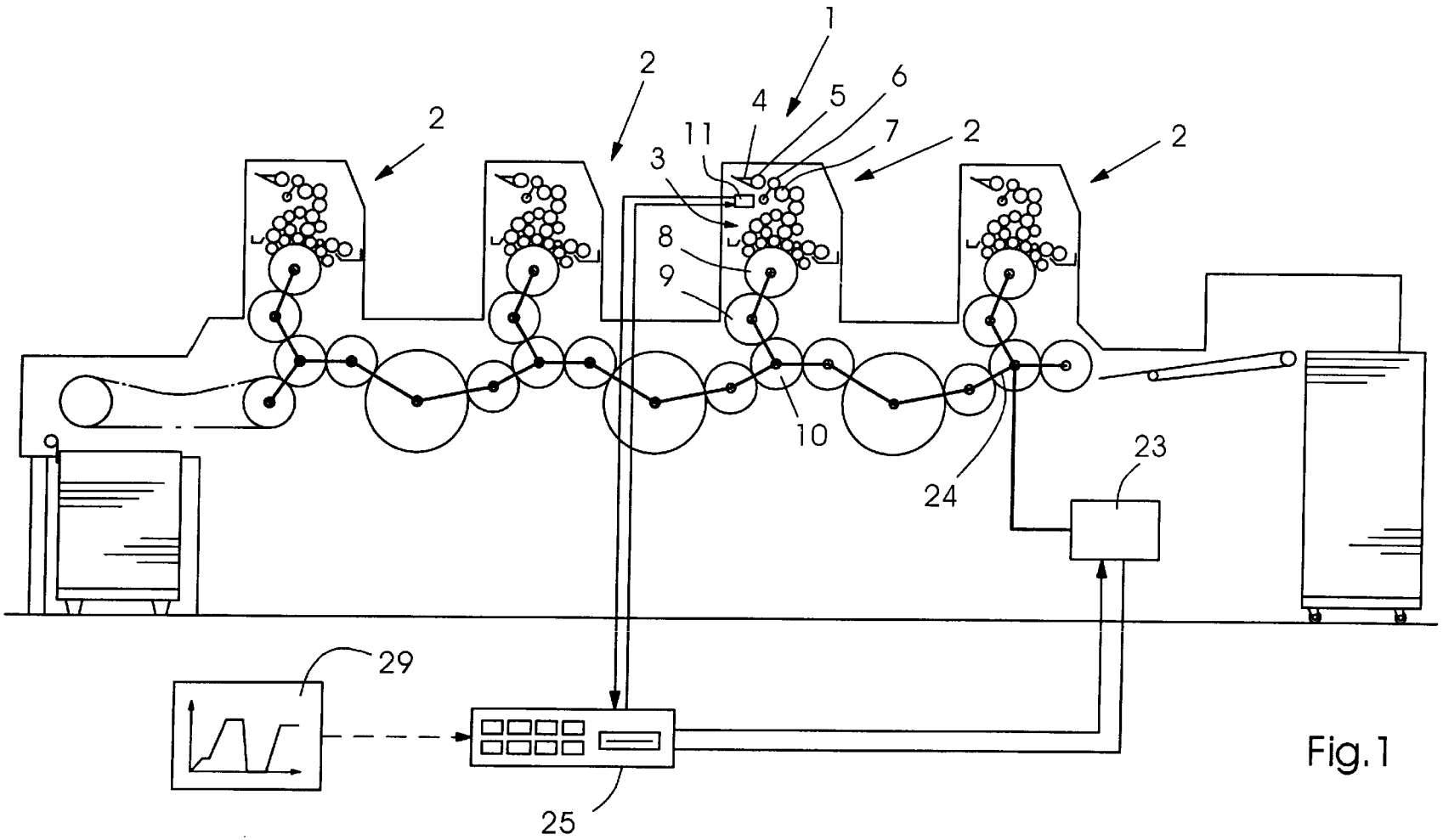
FIG. 1 is a diagrammatic and schematic side elevational view of a sheet-fed offset rotary printing press with several ductor or vibrator inking units.
Figure 2:
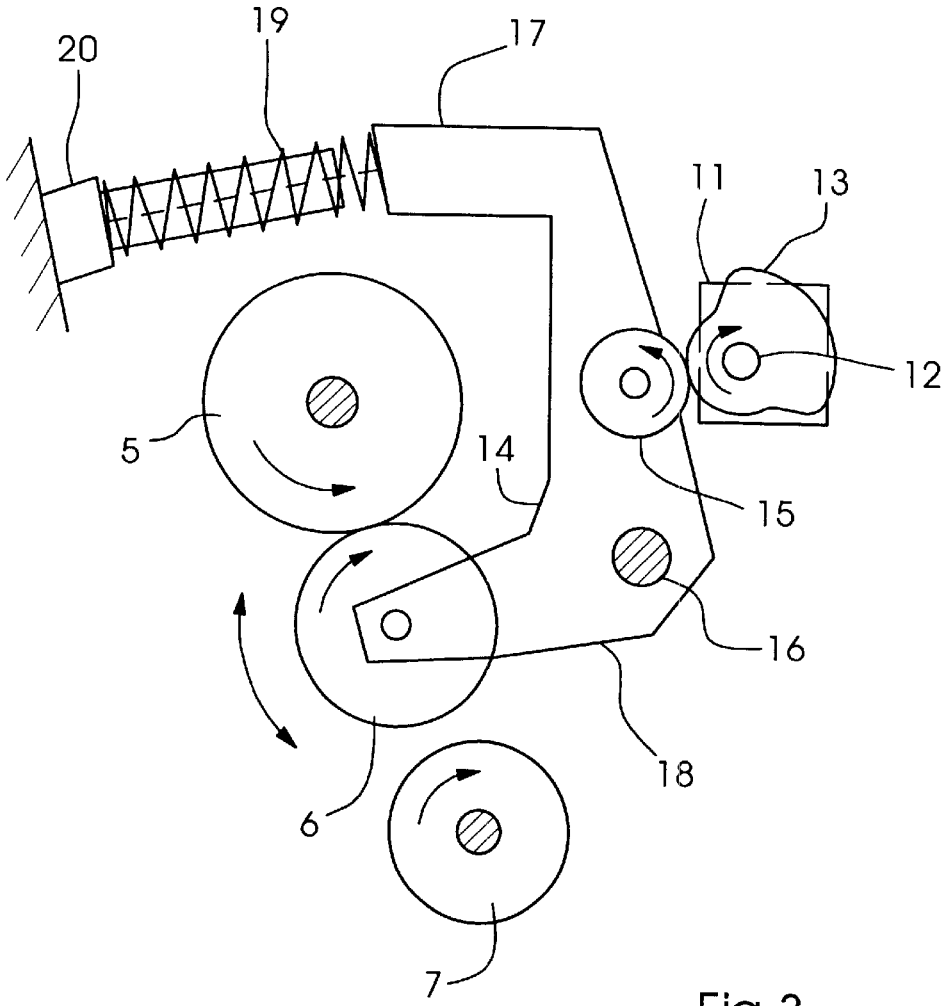
FIG. 2 is a diagrammatic side elevational view of a cam drive with a cam disc for driving a ductor or vibrator roller of one of the ductor or vibrator inking units of FIG. 1.

Referring now to the drawings and, first, particularly to FIG. 1 thereof, there is shown therein a printing press 1 provided with several printing units 2, namely four printing units in this exemplary embodiment of a printing press, each of the printing units 1 having an inking unit 3 for inking a printing form disposed peripherally on a form cylinder 8. The inking unit 3 includes several, namely four, inking-unit rollers 5 to 7, in this embodiment of the printing press, for transporting ink stored in an ink fountain or duct 4 to the form cylinder 8. The inking-unit roller 5 is formed as a fountain or duct roller assigned to the ink fountain 4, and the inking-unit roller 7 is formed as a distributor roller reciprocating or oscillating in an axial direction. The inking-unit roller 6 is a ductor or vibrator roller that reciprocates between the inking-unit rollers 5 and 7, making temporary contact therewith, and in so doing accepting the ink from the inking-unit roller 5 and transferring it to the inking-unit roller 7. This reciprocating movement of the ductor roller 6 is driven by a motor 11, realized as an electric motor, through the intermediary of a cam drive 13 to 19 (FIG. 2). The form cylinder 8 is rotatingly driven by the cam drive 13 to 19. The form cylinder 8, a blanket cylinder 9 and an impression cylinder 10 of each individual printing unit 2, as well as the printing units 2 themselves, between one another, are connected together by a gear train 24 so that all of the printing units 2 can be driven by a printing press drive 23 with the same printing speed of, for example, 10,000 sheets of printed material per hour. The motor 11 is controllable by an electronic control 25 dependent upon the drive 23, which is the main drive of the printing press 1. The operator of the printing press 1 can control the drive 23 through the intermediary of the electronic control 25 and, for example, can increase the printing speed from 10,000 sheets per hour to 15,000 sheets per hour. The motor 11 is linked electronically with the printing-press drive 23 via the control 25 so that the number of movements of the ductor roller 6 from the inking-unit roller 5 to the inking-unit roller 7 and back again per rotation of the form cylinder 8 is adjusted accordingly in response to changes in the printing speed of the drive 23. Although an electronic adjustment of the motor 11 may conform to a linear model, this does not necessarily have be the case. If, for example, at a printing speed of 10,000 sheets per hour, the ductor roller 6 periodically performs one repeating reciprocatory movement for every five rotations of the printing-form cylinder 8, it is possible, for example, that at 15,000 sheets per hour, one repetition of the movement of the ductor roller 6 for every three rotations of the form roller 8 is the ductor-roller cycle frequency which best corresponds to a great ink demand of the printing press 2 at a high printing speed. The frequency of the ductor roller 6 is controllable in accordance with the printing press drive 23 in conformity with a functional relationship that describes the ink demand at different printing speeds. In addition, the motor 11 can be controlled via the electronic control 25 independently of the printing press drive 23, so that the operator can change the motor speed or ductor frequency by manually adjusting the control 25 if the operator should realize from the printing image that the amount of ink transported by the ductor roller per unit time is too great or too small. A symbol identified by reference numeral 29 represents a corresponding functional course or sequence programmable in the control 25 or a storable data record entered therein, which serves as the basis for the aforementioned adjustment of the drive 13 to 16 of the ductor roller 6, the manual setting, and especially the rotation of the cam disc 13 (FIGS. 2, 3 and 6) with different speeds and possibly in different directions.

FIG. 2 illustrates in detail the inking-unit rollers 5 to 7 and the cam drive 13 to 19 reciprocatingly moving the ductor roller. The cam drive 13 to 19 is realized as a swivel mechanism and can also be a mechanism for pushing or sliding the ductor roller 6 reciprocatingly between the inking-unit rollers 5 and 7. In the latter case, the roller lever 14 would be replaced by a roller tappet that bears the ductor roller 6 and is operated by a cam disc 13. The illustrated roller lever 14 is swivellable about the lever bearing 16 and is realized as a double-armed angle or bellcrank lever. A spring 19 causes the lever roller 15, which is mounted so as to be rotatable on the roller lever 14, to be held securely on the peripheral surface of the cam disc 13. The ductor roller 6 is mounted so as to be rotatable at one end of the roller lever 14, the spring 19, that is realized as a pressure spring, being in engagement with the roller lever 14 at the other end of the latter. The roller 15 is rotatably mounted in the lever arm 17 between the pivot bearing 16 of the roller lever 14 and the contact location of the spring 19. The motor 11 that rotates the cam disc 13 is realized as an electric motor having a motor shaft 12 on which the cam disc 13 is mounted. The rotary movement of the inking-unit rollers 5 and 7 is generated by the printing-press drive 23 (FIG. 1) via the geared linkage or gear transmission of the rollers 5 and 7, and the rotary movement of the ductor roller 6 is generated by friction entrainment when the ductor roller 6 is in contact with the respective rotating inking-unit rollers 5 and 7.

Figure 3:
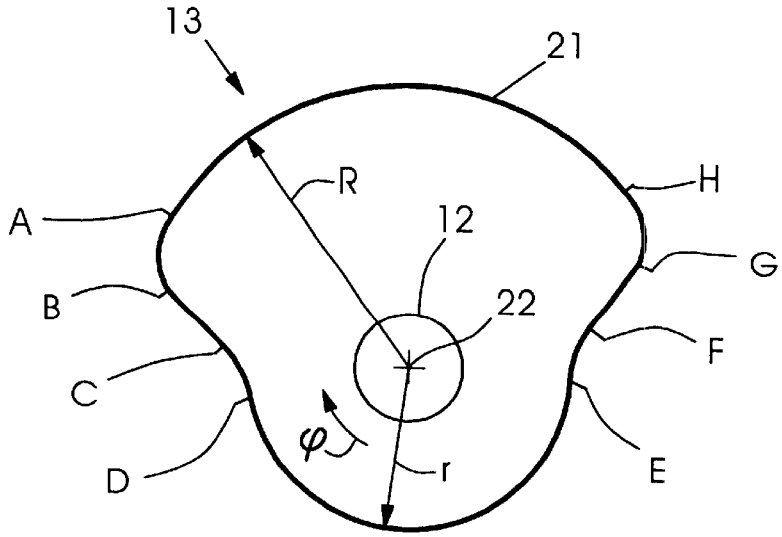
FIG. 3 is an enlarged fragmentary view of FIG. 2 showing a first embodiment of a cam disc therein in a different operating phase thereof.

The cam disc 13 is illustrated in detail in FIG. 3. The cam disc 13 is formed mirror symmetrically with reference to the longest axis thereof. The contour points A to H define different sections of the peripheral cam contour 21 of the cam disc 13. The cam disc 13 has a first peripheral section AH describing a circular arc and lying between the points A and H, and a second peripheral section DE describing a circular arc and lying between the points D and E. The radius of curvature R of the peripheral section AH is greater than the radius of curvature r of the peripheral section DE. The sections AH and DE describing circular arcs are connected by an approximately S-shaped curving transition section between the points A and D and an approximately mirror-image S-shaped transition section between the points E and H. The transition sections AD and EH, respectively, have a convex curved section AB and GH, respectively, an approximately linear section BC and FG, respectively, and a substantially concave curved section CD and EF, respectively. The curved sections AD and EH illustrated in FIG. 3 are formed so that these sections flow smoothly into the circular arc sections AH and DE. The ductor roller 6 is in a position making contact with one of the inking-unit rollers 5 or 7 while the roller 15 rolls over the section AH of the cam disc 13 or is at rest within this section. The ductor roller 6 is in a position of making contact with the respective other inking-unit roller 5 or 7 while the roller is rolling over the section DE or is at rest within this section. For the cam drive illustrated in FIG. 2, the roller 15 is shown as it rolls over the section DE of the cam disc 13, during this process the ductor roller 6 being in contact with the inking-unit roller 5 and accepting ink from the latter. While the roller 15 rolls over and through the transition sections AD and EH, the roller lever 14 moves about the lever bearing 16 and the ductor roller 6 moves from the inking-unit roller 5 to the inking-unit roller 7, or in reverse. The amount of ink accepted by the ductor roller 6 from the inking-unit roller 5 in the form of a peripheral stripe is dependent upon a so-called contact angle. The contact angle is that angle of rotation of the inking-unit roller 5 through which the inking-unit roller 5 rotates while the ductor roller 6 is in contact with the inking-unit roller 5. With a constant speed of rotation of the inking-unit roller 5, for example, the length of the stripes of ink transferred from the inking-unit roller 5 to the ductor roller 6 can be varied by varying the length of time that the ductor roller 6 is in contact with the inking-unit roller 5. The longer the ductor roller 6 is in contact with the inking-unit roller 5, the more ink is transferred. The duration of contact between the ductor roller 6 and the inking-unit roller 5 and the contact angle are for their part dependent upon the length of time during which the roller 15 is within the circular-arc section determining the contact of the ductor roller 6 with the inking-unit roller 5, which, in the illustrated example of FIG. 2, is the section DE. The length of time during which the roller 15 is within the section DE of the cam disc 13 is, in turn, determined by the angular velocity or rotational speed with which the cam disc 13 rotates while the roller 15 is within the section DE. As an example, the angular velocity for a variable duration can have the value zero, so that the roller 15 remains motionless within the section DE for this variable duration. Instead of stopping the rotation of the cam disc 13, as in the immediately preceding example, the cam disc 13 can also be rotated correspondingly faster or more slowly when the roller 15 is running over the section DE. The contact duration of the ductor roller 6 at the inking-unit roller 7 can be controlled in exactly the same manner, in this case the determining factors being the circular-arc section AH of the cam disc 13 and the time required for the roller 15 to travel through this section, or the duration of any pause in the rotation of the cam disc 13 while the roller 15 is within the section AH. While the roller 15 is moving within the section AD or EH, the cam disc 13 is rotated by the motor 11 at a maximum speed at which the roller 15 is held securely in contact with the cam disc 13 by the contact pressure device formed by the pressure spring 19 and the roller lever 17, without any lifting of the roller 15 from the outside contour 21 of the cam disc 13. This maximum speed, also referred to hereinbelow as the limit speed, is determined by the magnitude of the force exerted by the contact-pressure device 17, 19 on the roller 15 and from the course of the contour of the cam disc 13. The convex sections AB and GH are particularly critical. If the cam disc 13 rotates in the direction illustrated in FIG. 3, the danger exists, in the case wherein the permissible limit speed is exceeded, that the roller 15 rolling from A towards B may lift temporarily from the cam disc 13 because of a return inertia of the contact-pressure device 17, 19, and the roller 15 rolling from G to H may lift temporarily from the cam disc 13 as a result of centrifugal force. As explained in terms of the following FIGS. 4 and 5, this danger is avoided in that subsections, e.g., the subsections AB and GH of the approximately S-shaped transition sections AD and EH, as a result of different cam-disc kinematics, are moved along the roller 15 with a different speed than the other sections of the respective S-shaped transitions AD and EH. The drive kinematics of the cam disc 13 by the motor 11 includes, on the one hand, the influencing of the dwell time of the ductor roller 6 in the operating points thereof, in that the rotation of the cam disc 13 is appropriately accelerated and decelerated while the roller 15 is within the circular arc section AH or DE and, on the other hand, in that rolling through the S-shaped sections AD and EH takes place at optimum, i.e., maximum, speed. In this manner, the ductor roller 6 changes from one operating point to the other within a minimum duration of time so that, for a given ductor-roller frequency of, for example, one ductor-roller cycle per five rotations of the printing-form cylinder 8, the time duration for which the ductor roller 6 remains at the respective operating points, and makes contact with the respective inking-unit roller 5 and 7, respectively, is variable within an optimally large time span. Because the sections AD and EH are rotated with the maximum possible speed past the roller 15 running through these sections AD and EH, it is possible within the machine cycle to stop the roller 15 for a maximum length of time within the section DE or to enable the roller 15 to run especially slowly over and through this section DE. While the roller 15 runs over and through at least one S-shaped transition section AD and/or EH, the cam disc 13 is also rotated at a speed adapted to the individual subsections, e.g., the subsection AB, each of the subsections being traversed by the roller 15 at the optimal speed and at a speed appropriate to the different permissible limit speeds of the subsections.

Figure 4:
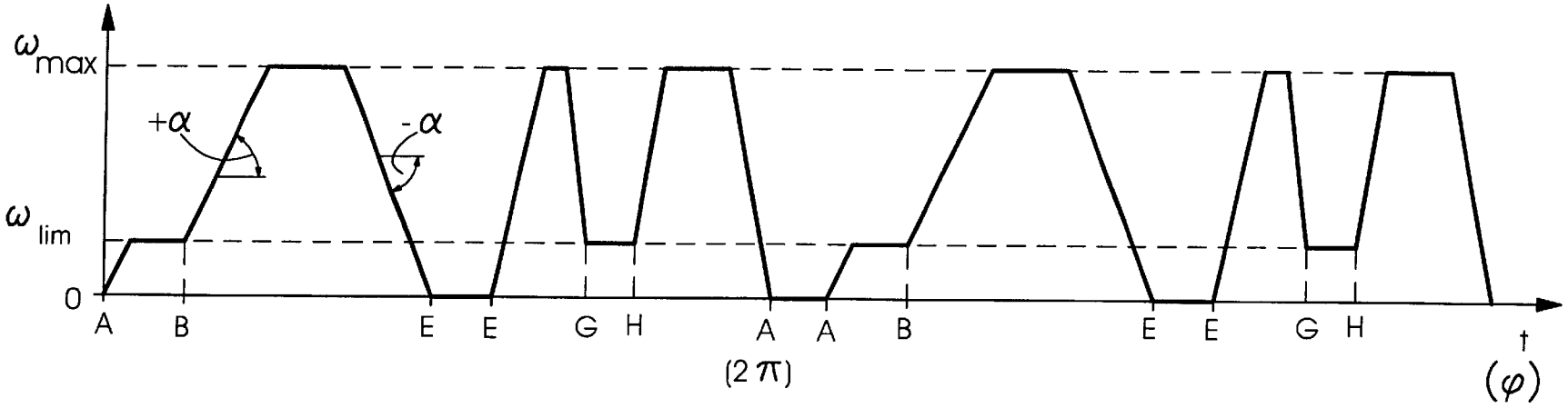
FIG. 4 is a plot diagram illustrating a periodic course of movement of the first embodiment of the cam disc.

FIG. 4 is a plot diagram illustrating the cam kinematics of the cam disc 13 illustrated in FIG. 3. The cam disc 13 is rotated intermittently, i.e., with occasional stops, in a single direction. The abscissa is a time axis which also includes reference characters to indicate the position of the roller 15 on the periphery of the cam disc 13 at the respective point in time. The ordinate axis represents the angular velocity with which the cam disc 13 is rotating. The gradient of the increase or decrease of the speed curve shown in the diagram is a measure of the magnitude of the angular acceleration of the cam disc 13, the character $+\alpha$ indicating a positive angular acceleration and the character $-\alpha$ indicating a negative angular acceleration, i.e., a deceleration. At zero time instant, the roller 15 is at the point A. The cam disc 13 is then accelerated with the maximum acceleration of the system to the limit speed $\omega_{lim}$, just below the speed at which the roller lever 14 lifts off, so that the roller 15 travels over and through the section AB as quickly as possible. After the roller 15 has passed the point B, the cam disc 13 is accelerated again with the maximum system acceleration to the maximum speed of the system in order to travel to the point E, where the cam disc 13 is brought to rest with the maximum deceleration of the system. The roller remains at point E long enough for the ductor roller to accept the necessary amount of ink. The cam disc 13 is then accelerated to the maximum speed of the system at the maximal acceleration of the system. The cam disc 13 is then decelerated at the maximum deceleration of the system to the limit speed at which the roller lever 14 does not yet lift off, and the section GH is traversed at this limit speed. When the roller 15 reaches the contour point H, the cam disc 13 is accelerated with the maximum acceleration of the system to the maximum speed of the system $\omega_{max}$ to travel to the point A, and the cam disc 13 is then braked to zero speed with the maximum deceleration of the system. The dwell time of the roller 15 at the point A depends upon the desired cycle time. The course of the rotational speed is optimal if, independent of printing or machine speed, the acceleration and deceleration values are the maximum possible, the limit speed $\omega_{lim}$ and the speed within the sections AB and GH is that just before the roller lever lifts off, and the speed $\omega_{max}$ attained within the sections BE, EG and AH is the maximum speed of the system. The cam kinematics described with reference to FIG. 4 are based upon a periodic, frequently repeating, complete rotation of the cam disc 13.

Figure 5:
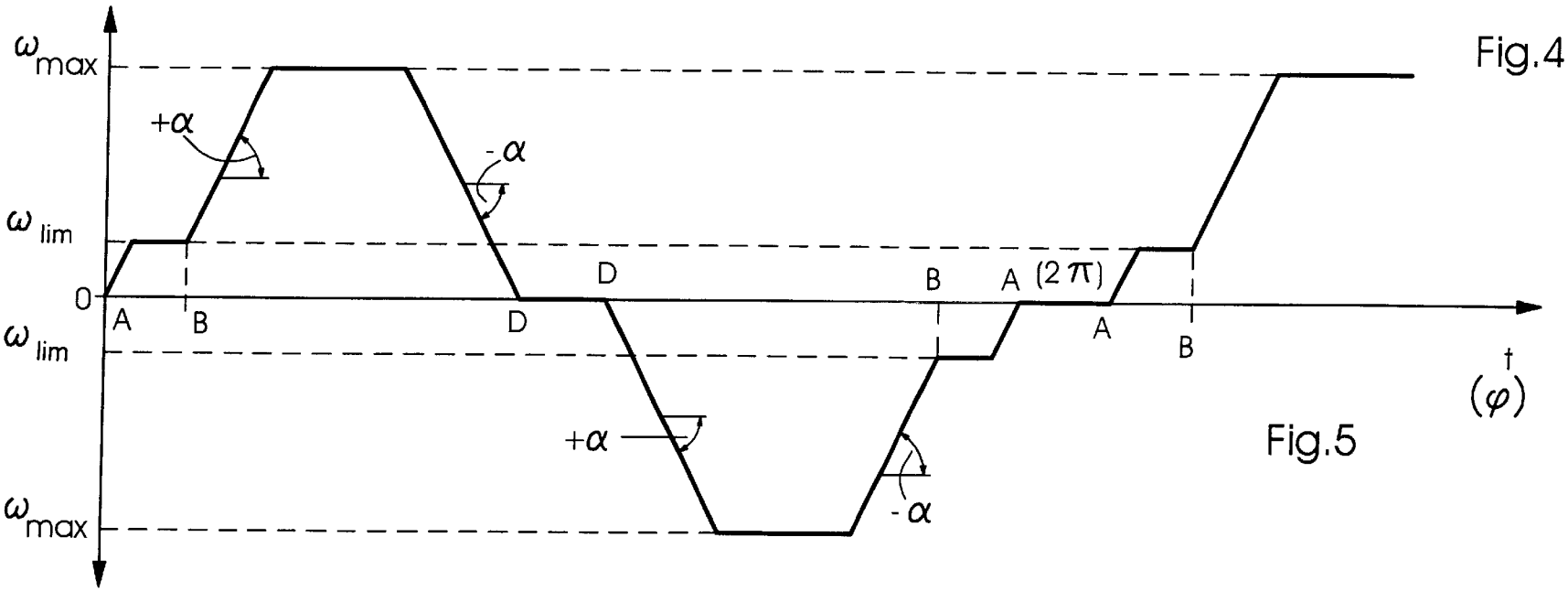
FIG. 5 is a plot diagram illustrating an alternative periodic course of movement of the first embodiment of the cam disc.

FIG. 5 is a plot diagram illustrating a course of movement of the cam disc 13 wherein only a single transition section AD is traversed. In this case, the cam disc 13 can be formed segment-shaped and does not perform a complete rotation. For the first part of the cam course illustrated in FIG. 5, up to the point D where the roller 15 stops, the speed profile described in connection with FIG. 4 essentially applies. A difference in the speed profile illustrated in FIG. 4 is that the cam disc 13 is stopped when the roller 15 has reached the point D and remains there in order that the ductor roller 6 can accept the quantity of ink from the inking-unit roller 5. The significant aspect of the speed profile shown in FIG. 5 is that, after acceptance of the ink, i.e., after the cam roller 15 has stopped at the point D, the cam disc 13 is rotated back in the negative direction so that the roller 15 rolls back from point D to point A. The second part of the speed profile according to FIG. 5, which extends in the negative direction of the ordinate axis, corresponds to the first part of the speed profile according to FIG. 5 in a form mirrored doubly through both the vertical axis running through point D and through the abscissa axis. Each of the angular accelerations and angular decelerations which are plotted are maximal with respect to the system. The angular velocities $+\omega_{max}$, $-\omega_{max}$ have magnitudes in opposite directions equal to the maximum of the system, and the limit speeds $+\omega_{lim}$, $-\omega_{lim}$ are, also in opposite directions, respectively, the maximum speeds before the roller lever 14 lifts off.

Figure 6:
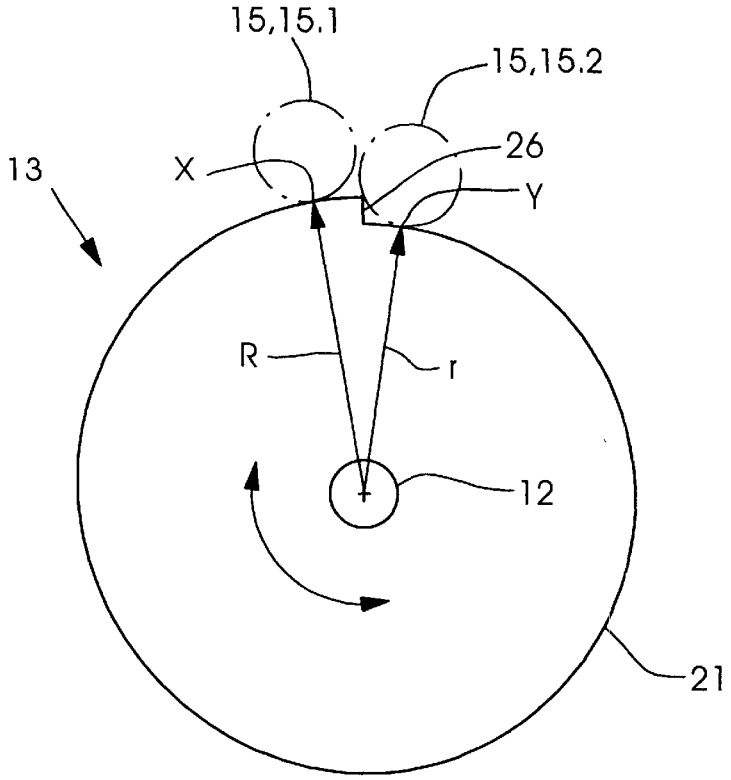
FIG. 6 is a view like that of FIG. 3 of a second embodiment of the cam disc.

FIG. 6 illustrates a further embodiment of the cam disc 13 that has a spiral peripheral contour and is substantially exclusively convex. The peripheral sections which are defined by the different magnitudes of the radii of curvature A, a are not contoured as circular arcs, the radius of curvature R gradually decreasing according to a suitable function, e.g., a spiral of Archimedes, until it is transformed into the radius of curvature r. The operating point identified by the reference character X is the point at which the ductor roller 6 is in contact with the inking-unit roller 7 for delivering ink, and the operating point identified by the reference character Y is the point at which the ductor roller 6 is in contact with the inking-unit roller 5 and accepts ink therefrom. The two positions of the roller 15 at 15.1 and 15.2, respectively, on the cam contour 21 are illustrated in phantom in FIG. 6. The step-shaped transition 26 can serve as a stop for the roller 15.

Figure 7:
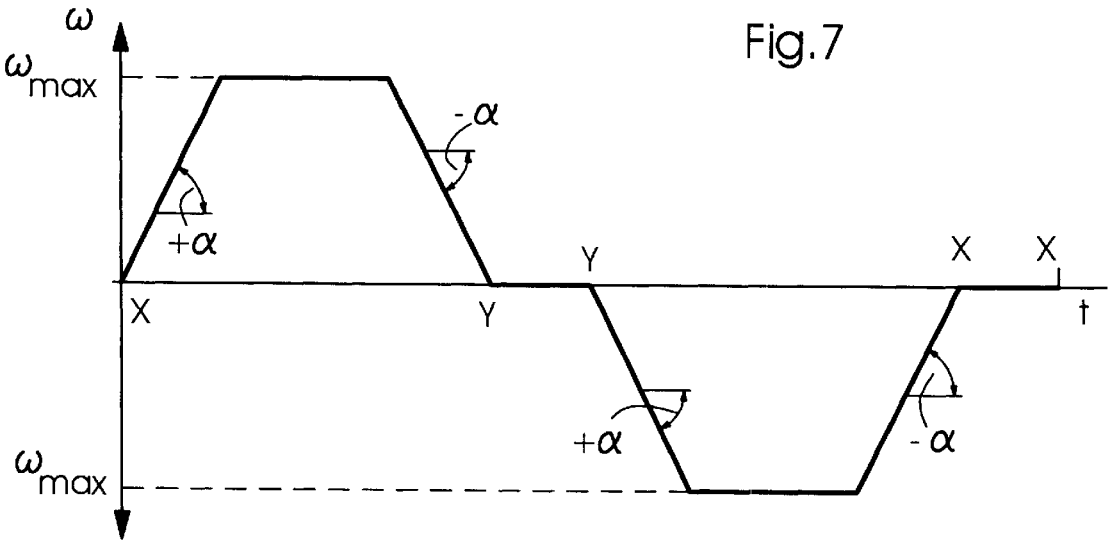
FIG. 7 is a plot diagram illustrating a periodic course of movement of the second embodiment of the cam disc.

The speed profile illustrated in FIG. 7 shows the movement of the cam disc 13 illustrated in FIG. 6. The cam disc 13 is turned alternatinglyely in both directions of rotation and stopped temporarily when the roller is at the points X and Y respectively. The dwell time at the point Y is of such sufficient length that a necessary amount of ink is accepted by the ductor roller 6. The dwell time of the roller 15 at the point X depends upon the required cycle time. The acceleration $+\alpha$ and deceleration $-\alpha$ characterized by climbing and falling straight lines of the cam course are, respectively, the maximum acceleration and deceleration of the system. The angular velocities characterized by horizontally running straight lines are the maximum speeds $+\omega_{max}$, $-\omega_{max}$ of the system. The cam disc 13 illustrated in FIG. 6 has the advantage that the cam contour 21 has no peripheral section that would cause the roller 15 to lift off the cam disc 13.

The speed profiles shown in the FIGS. 4 to 6 are programmed in the electronic control system 25 (FIG. 1) so that the latter can control the motor 11 accordingly.

Figure 8:
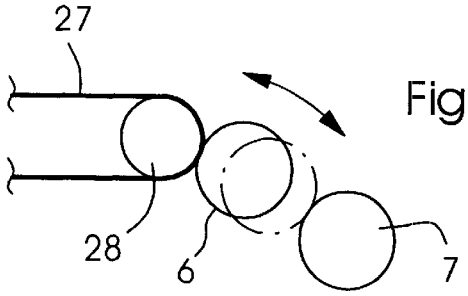
FIG. 8 is a diagrammatic fragmentary side elevational view of a ductor or vibrator inking unit wherein the ductor or vibrator roller accepts ink from an ink-transporting belt.

FIG. 8 illustrates that at least one of the inking-unit rollers 5 and 7 can be replaced by an ink-transporting belt 27. The ink-transporting belt 27 is preferably formed as an endless circulating rubber belt looping round an inking-unit roller 28. In this case, the ductor roller 6 accepts the ink from the ink-transporting belt 27 instead of from the inking-unit roller 5. In the foregoing descriptive sections, the expressions inking-unit roller 5 and inking-unit roller 7 can, of course, be replaced by the expressions ink-conveying device 5 and ink-conveying device 7 respectively, in which case, the ink-conveying device 5, 7 can be an ink-transporting belt.

We claim:

1. A ductor inking unit for a printing press comprising:

a ductor roller;

a rotatable cam disc having two peripheral sections contoured as circular arcs and defined by different radii of curvature;

a cam roller rolling on said cam disc;

a motor for moving said ductor roller via said rotatable cam disc and via said cam roller, said motor being constructed so as to drive said cam disc with periodic angular acceleration at constant printing speed of the printing press; and said cam disc being decelerated by said motor such that said cam disc rotates at a speed reduced with respect to a speed prior to being decelerated when said cam roller traverses a peripheral section of said cam disc having a curvature tending to cause said cam roller to be lifted from said cam disc.

2. The ductor inking unit according to claim 1, wherein said motor is constructed so as to drive said cam disc in a single direction of rotation.

3. The ductor inking unit according to claim 1, wherein said motor is constructed so as to turn said cam disc alternatingly in opposite directions of rotation.

4. In combination with a printing press, the ductor inking unit according to claim 1.

5. The ductor inking unit according to claim 1, including an electronic control for controlling the motor according to the printing speed and ink demand.

6. A method for operating a ductor inking unit of a printing press, comprising:

providing a ductor roller movable via a rotatable cam disc having two peripheral sections contoured as circular arcs defined by two different radii of curvature, a spring-loaded cam roller rolling on said cam disc, and a motor for rotating said cam disc;

driving said cam disc by said motor with periodic angular acceleration at constant printing speed of the printing press; and controlling said motor so that said spring-loaded cam roller rolling on said cam disc is held securely in contact with said cam disc at all times, by decelerating said cam disc such that said cam disc rotates at a speed reduced with respect to a speed prior to the decelerating when the cam roller runs over a peripheral section of the cam disc the curvature of which tends to lift the cam roller from the cam disc.

7. The method for operating a ductor inking unit according to claim 6, which further comprises carrying out the step of controlling the motor using an electronic control according to the printing speed and ink demand.

* * * * *